US009141006B2

(12) United States Patent
Wu

(10) Patent No.: US 9,141,006 B2
(45) Date of Patent: Sep. 22, 2015

(54) IMAGING MEMBER HAVING IMPROVED IMAGING LAYERS

(71) Applicant: XEROX CORPORATION, Norwalk, CT (US)

(72) Inventor: Jin Wu, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 6 days.

(21) Appl. No.: 14/056,820

(22) Filed: Oct. 17, 2013

(65) Prior Publication Data

US 2015/0111136 A1 Apr. 23, 2015

(51) Int. Cl.
*G03G 5/05* (2006.01)
*G03G 15/00* (2006.01)

(52) U.S. Cl.
CPC ..... *G03G 5/0564* (2013.01); *G03G 15/75* (2013.01); *G03G 15/751* (2013.01)

(58) Field of Classification Search
CPC ..... G03G 5/0564
USPC ..... 430/59.6, 59.1, 96
See application file for complete search history.

(56) References Cited

U.S. PATENT DOCUMENTS

| | | | | |
|---|---|---|---|---|
| 3,121,006 | A | 2/1964 | Middleton et al. | |
| 4,587,189 | A | 5/1986 | Hor et al. | |
| 5,069,993 | A | 12/1991 | Robinette et al. | |
| 5,141,832 | A * | 8/1992 | Takegawa et al. | 430/96 |
| 5,415,961 | A | 5/1995 | Yu et al. | |
| 5,550,618 | A | 8/1996 | Herbert et al. | |
| 5,885,737 | A * | 3/1999 | Tanaka | 430/58.35 |
| 7,125,951 | B2 * | 10/2006 | Boyles et al. | 528/196 |
| 8,623,578 | B2 * | 1/2014 | Wu et al. | 430/59.6 |
| 2006/0057480 | A1 | 3/2006 | Lin et al. | |
| 2006/0105264 | A1 | 5/2006 | Dinh et al. | |
| 2007/0072101 | A1 | 3/2007 | Dinh et al. | |
| 2007/0134573 | A1 | 6/2007 | Yanus et al. | |
| 2007/0196752 | A1 | 8/2007 | Dinh et al. | |
| 2011/0245541 | A1 * | 10/2011 | Tong | 564/443 |

OTHER PUBLICATIONS

Diamond, A.S., ed., Handbook of Imaging Materials, Marcel Dekker, Inc., NY (1991), pp. 395-396.*

Diamond, A.S., et al., Handbook of Imaginng Materials Second Edition, Marcel Dekker, Inc., NY (2002), pp. 146-148.*

* cited by examiner

*Primary Examiner* — Janis L Dote

(74) *Attorney, Agent, or Firm* — Pillsbury Winthrop Shaw Pittman LLP

(57) ABSTRACT

The presently disclosed embodiments are directed to charge transport layers useful in electrostatography. More particularly, the embodiments pertain to an electrostatographic imaging member having imaging layers that exhibit improved electrical performance. In these embodiments, both the charge generation layer and charge transport layer comprise a tetra-aryl polycarbonate copolymer.

13 Claims, 3 Drawing Sheets

IMAGING MEMBER HAVING IMPROVED IMAGING LAYERS

BACKGROUND

The presently disclosed embodiments relate generally to layers that are useful in imaging apparatus members and components, for use in electrostatographic, including digital, apparatuses. More particularly, the embodiments pertain to an electrostatographic imaging member having imaging layers that exhibit improved electrical performance. In these embodiments, both the charge generation layer and charge transport layer comprise a tetra-aryl polycarbonate copolymer.

Electrophotographic imaging members, e.g., photoreceptors, photoconductors, and the like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer, an optional undercoat layer, and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

One type of composite photoconductive layer used in xerography is illustrated in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron-hole pair when exposed image wise and inject only the holes through the CTL. In the alternate case when the CTL is sandwiched between the CGL and the conductive layer, the outer surface of CGL layer is charged positively while the conductive layer is charged negatively and the holes are injected from the CGL to the CTL. The CTL should be able to transport the holes with as little trapping of charge as possible. In flexible web like photoreceptor, the charge conductive layer may be a thin coating of metal on a thin layer of thermoplastic resin.

In a typical machine design, a drum photoreceptor is coated with one or more coatings applied by well-known techniques such as dip coating or spray coating. Dip coating of drums usually involves immersing of a cylindrical drum while the axis of the drum is maintained in a vertical alignment during the entire coating and subsequent drying operation. Because of the vertical alignment of the drum axis during the coating operation, the applied coatings tend to be thicker at the lower end of the drum relative to the upper end of the drum due to the influence of gravity on the flow of the coating material. Coatings applied by spray coating can also be uneven, e.g., orange peel effect. Coatings that have an uneven thickness do not have uniform electrical properties at different locations of the coating. Under a normal machine imaging function condition, the photoreceptor is subjected to physical/mechanical/electrical/chemical species actions against the layers due to machine subsystems interactions. These machine subsystems interactions contribute to surface contamination, scratching, abrasion and rapid surface wear problems.

As electrophotography advances, the complex, highly sophisticated duplicating systems also need to operate at very high speeds which places stringent requirements on photoreceptors and may reduce photoreceptor performance as well as longevity. Thus, there is a continued need for achieving improved performance and increased life span of photoconductive imaging members.

SUMMARY

According to aspects illustrated herein, there is provided an imaging member comprising an imaging member comprising: a substrate; a charge generation layer disposed on the substrate; and a charge transport layer disposed on the charge generation layer; wherein both the charge generation layer and the charge transport layer comprise a polymeric binder comprising a tetra-aryl polycarbonate copolymer.

Another embodiment provides an imaging member comprising an imaging member comprising: a substrate; a charge generation layer disposed on the substrate; a charge transport layer disposed on the charge generation layer; wherein both the charge generation layer and the charge transport layer comprise a polymeric binder comprising a tetra-aryl polycarbonate copolymer, wherein the tetra-aryl polycarbonate copolymer is selected from the group consisting of:

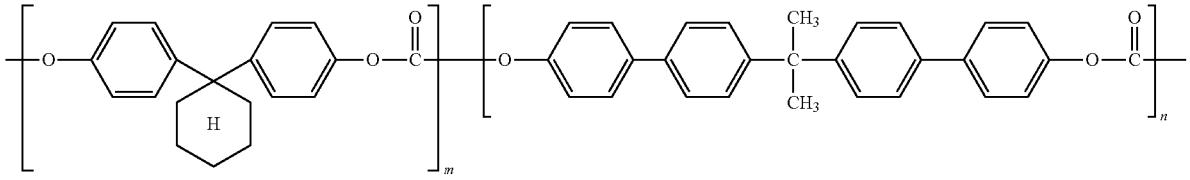

wherein m can be from about 60 mol % to about 95 mol % and n can be from about 5 mol % to about 40 mol %, with a viscosity average molecular weight range of from about 30,000 to about 70,000;

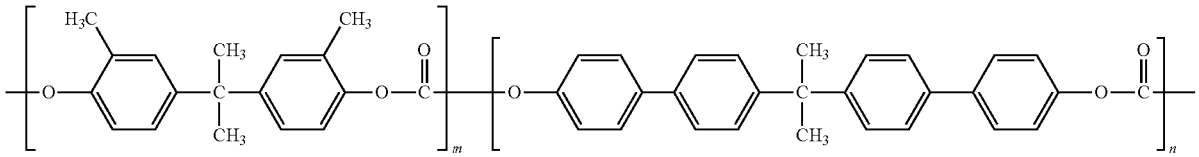

wherein m can be from about 60 mol % to about 95 mol % and n can be from about 5 mol % to about 40 mol %, with a viscosity average molecular weight range of from about 30,000 to about 70,000;

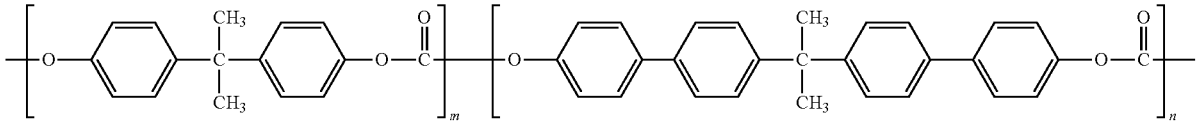

wherein m can be from about 60 mol % to about 95 mol % and n can be from about 5 mol % to about 40 mol %, with a viscosity average molecular weight range of from about 30,000 to about 70,000.

Yet another embodiment, there is an image forming apparatus for forming images on a recording medium comprising an image forming apparatus for forming images on a recording medium comprising: a) an imaging member having a charge retentive-surface for receiving an electrostatic latent image thereon, wherein the imaging member comprises substrate; a charge generation layer disposed on the substrate; a charge transport layer disposed on the charge generation layer; and wherein both the charge generation layer and the charge transport layer comprise a polymeric binder comprising a tetra-aryl polycarbonate copolymer; b) a development component for applying a developer material to the charge-retentive surface to develop the electrostatic latent image to form a developed image on the charge-retentive surface; c) a transfer component for transferring the developed image from the charge-retentive surface to a copy substrate; and a fusing component

BRIEF DESCRIPTION OF THE DRAWINGS

For a better understanding, reference may be made to the accompanying figures.

DETAILED DESCRIPTION

Figure 1:
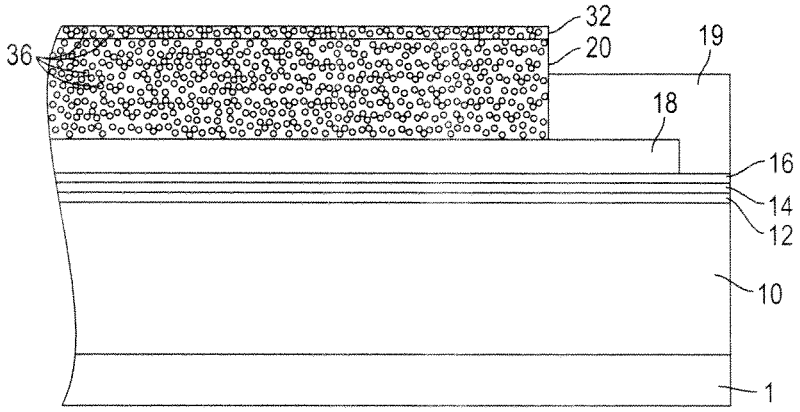
FIG. 1 is a cross-sectional view of an imaging member in a belt configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments are directed generally to an improved electrostatographic imaging member having charge generation and charge transport layers both comprising a tetra-aryl polycarbonate copolymer. The imaging member of the present embodiments exhibit good electrical performance. When incorporated into the charge transport layer, the tetra-aryl polycarbonate copolymer provides long charge transport layer life. The incorporation of the tetra-aryl polycarbonate copolymer into the charge generation layer, instead of conventional polycarbonates like polycarbonate Z homopolymer, provides better electrical performance. Thus, the combination of the improved imaging layers provide long life imaging members which also demonstrate the capability of producing high quality prints at elevated process speeds.

In a typical electrostatographic reproducing or digital printing apparatus using a photoreceptor, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

Although the coatings disclosed herein are applicable to electrophotographic imaging members in either flexible belt configuration or rigid drum form, for reason of simplicity, the discussions below are focused upon electrophotographic imaging members in drum form, as generally disclosed, for example, in U.S. Pat. Nos. 5,415,961 and 5,550,618. The long-term durability of drum-type photoreceptors greatly exceeds that of belt-type photoreceptors. Some drum photoreceptors are coated with one or more coatings. Coatings may be applied by well-known techniques such as dip coating or spray coating. Dip coating of drums usually involves immersing of a cylindrical drum while the axis of the drum is maintained in a vertical alignment during the entire coating and subsequent drying operation.

FIG. 1 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer (also referred to an interfacial layer) 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference. Organic photoreceptors usually comprise a metallized substrate, undercoat layer, charge generation layer (CGL) and charge transport layer (CTL), sequentially. To form a latent image on the surface of photoreceptor, a charged photoreceptor has to be exposed by light, which usually is a laser with wavelength in visible light range. The ideal situation would be one in which the charge generation layer could absorb all the incident photons and no exposure light could penetrate through the CGL. In reality, however, there is always a small amount of light that passes through the CGL and UCL, and is then reflected back through the photoreceptor. This light interference results in a print defect.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion, such as disclosed in U.S. Publication No. 2006/0105264, U.S. Publication No. 2007/0072101, U.S. Publication No. 2007/0134573, and U.S. Publication No. 2007/0196752, which are all hereby incorporated by reference. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoatings may be continuous and have a thickness from about 0.5 micrometer to about 10 micrometers, in embodiments from about 2 micrometers to about 6 micrometers.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, mixtures thereof and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may range from about 500 micrometers to about 3,000 micrometers, or from about 750 micrometers to about 2500 micrometers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Undercoat Layer

General embodiments of the undercoat layer may comprise a metal oxide and a resin binder. An example of an undercoat layer is disclosed in U.S. Patent Publication No. 2006/0057480, which is hereby incorporated by reference in its entirety.

The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Typical undercoat layer binder materials include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like. Other examples of suitable undercoat layer binder materials include, but are not limited to, a polyamide such as LUCKAMIDE 5003 from DAINIPPON Ink and Chemicals, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, p. 76, John Wiley and Sons Inc. (1968), and the like and mixtures thereof. These polyamides can be alcohol soluble, for example, with polar functional groups, such as methoxy, ethoxy and hydroxy groups, pendant from the polymer backbone. Another examples of undercoat layer binder materials include aminoplast-formaldehyde resin such as CYMEL resins from CYTEC, poly(vinyl butyral) such as BM-1 from Sekisui Chemical, and the like and mixtures thereof. Further binder materials include phenolic-formaldehyde resin such as VARCUM 29159 from Oxychem Company. Examples of phenolic resins include formaldehyde polymers with phenol, p-tert-butylphenol, cresol, such as VARCUM 29159 and 29101 (Oxychem Company) and DURITE 97 (Borden Chemical), formaldehyde polymers with ammonia, cresol and phenol, such as VARCUM 29112 (OxyChem Company), formaldehyde polymers with 4,4'-(1-methylethylidene)bisphenol, such as VARCUM 29108 and 29116 (OxyChem Company), formaldehyde polymers with cresol and phenol, such as VARCUM 29457 (OxyChem Company), DURITE T SD-42 A., SD-422A (Borden Chemical), or formaldehyde polymers with phenol and p-tert-butylphenol, such as DURITE ESD 556C (Border Chemical). In a specific embodiment, the undercoat layer is a three component layer comprising γ-Aminopropyltriethoxysilane, tributoxyzirconiumacetylacetonate, and polyvinylbutyral.

The weight/weight ratio of the metal oxide and resin binder in the undercoat layer formulation is from about 50:50 to about 70:30, or from about 55:45 to about 65:35. In embodiments, the undercoat layer comprises from about 50:50 to about 70:30, or from about 55:45 to about 65:35 $TiO_2$:phenolic resin, which, in further embodiments, is dispersed in from about 30:70 to about 70:30 alcohol solution, such as Xyl:BuOH solvent mixture and the like.

In various embodiments, the undercoat layer further contains an optional light scattering particle. In various embodiments, the light scattering particle has a refractive index different from the binder and has a number average particle size greater than about 0.8 μm. The light scattering particle can be amorphous silica or silicone ball. In various embodiments, the light scattering particle can be present in an amount of from about 0% to about 10% by weight of the total weight of the undercoat layer.

In the present embodiments, the undercoat layer has a thickness of from about 0.75 μm to about 2 μm, or from about 0.5 μm to about 3 μm.

The undercoat layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the undercoat layer.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of from about 0.01 micrometers to about 900 micrometers after drying. In embodiments, the dried thickness is from about 0.03 micrometers to about 1 micrometer.

The Charge Generation Layer

The charge generation layer 18 may thereafter be applied to the undercoat layer 14. In the present embodiments, the charge generation layer comprises a tetra-aryl polycarbonate copolymer as the polymeric binder 36. In embodiments, the tetra-aryl polycarbonate copolymer can be any of the structures below, and the like, and mixtures thereof:

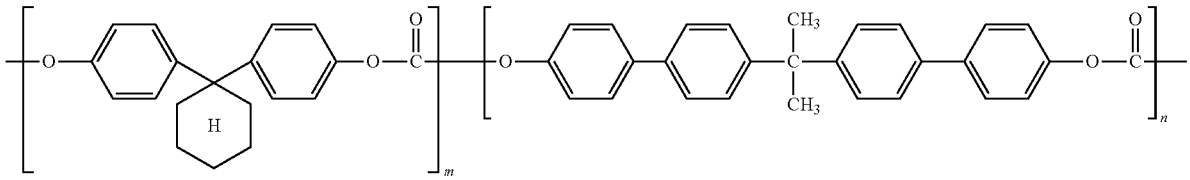

wherein m can be from about 50 mol % to about 99 mol % and n can be from about 1 mol % to about 50 mol %, with a viscosity average molecular weight range of from about 20,000 to about 90,000. In a particular embodiment having this structure, m is 70 mol % and n is 30 mol %, and the viscosity average molecular weight is 56,900. In another particular embodiment having this structure, m is 75 mol % and n is 25 mol %, and the viscosity average molecular weight is 55,300. In yet another particular embodiment having this structure, m is 80 mol % and n is 20 mol %, and the viscosity average molecular weight is 64,600.

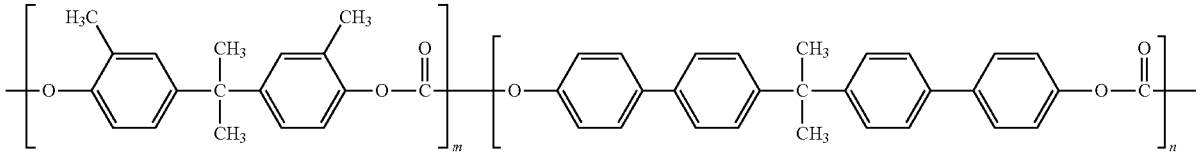

wherein m can be from about 50 mol % to about 99 mol % and n can be from about 1 mol % to about 50 mol %, with a viscosity average molecular weight range of from about 20,000 to about 90,000. In a particular embodiment having this structure, m is 80 mol % and n is 20 mol %, and the viscosity average molecular weight is 62,300.

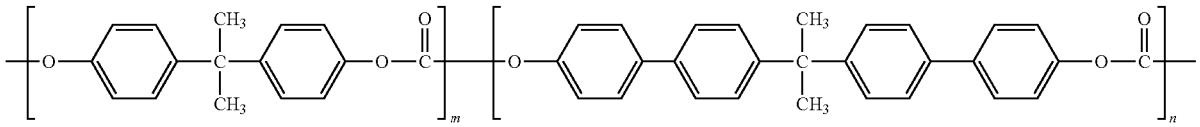

wherein m can be from about 50 mol % to about 99 mol % and n can be from about 1 mol % to about 50 mol %, with a viscosity average molecular weight range of from about 20,000 to about 90,000. In a particular embodiment having this structure, m is 70 mol % and n is 30 mol %, and the viscosity average molecular weight is 54,800. In another particular embodiment having this structure, m is 75 mol % and n is 25 mol %, and the viscosity average molecular weight is 52,500. In yet another particular embodiment having this structure, m is 80 mol % and n is 20 mol %, and the viscosity average molecular weight is 62,600.

In the above structures, both m/n ratio and molecular weight can be varied for optimizing properties. In the present embodiments, the tetra-aryl polycarbonate copolymer 36 is present in the charge generation layer in an amount of from about 10 to about 90, or from about 20 to about 80, or from about 30 to about 70 percent by weight of the total weight of the charge generation layer. In imaging members comprising such charge generation layers, there is exhibited improved electrical performance such as less residual potential (Vr) cycle up and lower dark decay.

Generally, any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Generally, any suitable inactive resin materials may be employed as a binder in the charge generation layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, from about 5 percent by volume to about 90 percent by volume of the charge generating material is dispersed in about 95 percent by volume to about 10 percent by volume of the resinous binder, and more specifically from about 20 percent by volume to about 60 percent by volume of the charge generating material is dispersed in about 80 percent by volume to about 40 percent by volume of the resinous binder composition.

In specific embodiments, the charge generation layer 18 may have a thickness ranging from about 0.1 μm to about 2 μm, or from about 0.2 μm to about 1 μm. These embodiments comprise a single pigment, such as chlorogallium phthalocyanine, hydroxygallium phthalocyanine, titanyl phthalocyanine, benzimidazole perylene or the like. Specific embodiments have a blend of the single pigment to binder in a weight ratio of from about 10:90 to about 90:10, or more specifically, from 40:60 to 80:20.

The charge generation layer 18 containing the charge generating material and the resinous binder material generally ranges in thickness of from about 0.1 μm to about 5 μm, for example, from about 0.2 μm to about 3 μm when dry. The charge generation layer thickness is generally related to binder content. Higher binder content compositions generally employ thicker layers for charge generation.

The Charge Transport Layer

In a belt photoreceptor, the charge transport layer may comprise a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder 36, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component typically comprises small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (mTPD), N,N,N',N'-tetra-p-tolyl-1,1'-biphenyl-4,4'-diamine tetramethyl-TPD other arylamines like triphenyl amine, and the like.

In the present embodiments, the charge transport layer comprises a tetra-aryl polycarbonate copolymer as the polymeric binder 36. In embodiments, the tetra-aryl polycarbonate copolymer 36 can be any of the structures below, and the like, and mixtures thereof:

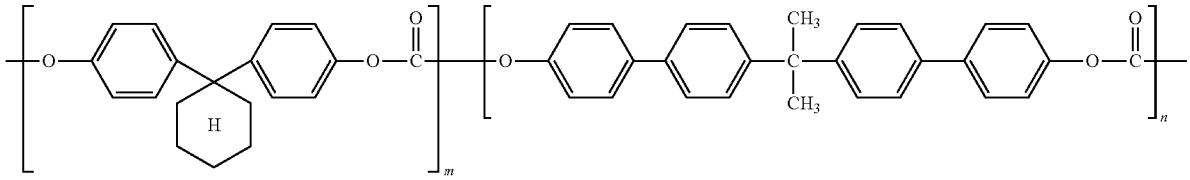

wherein m can be from about 50 mol % to about 99 mol % and n can be from about 1 mol % to about 50 mol %, with a viscosity average molecular weight range of from about 20,000 to about 90,000. In a particular embodiment having this structure, m is 70 mol % and n is 30 mol %, and the viscosity average molecular weight is 56,900. In another particular embodiment having this structure, m is 75 mol % and n is 25 mol %, and the viscosity average molecular weight is 55,300. In yet another particular embodiment having this structure, m is 80 mol % and n is 20 mol %, and the viscosity average molecular weight is 64,600.

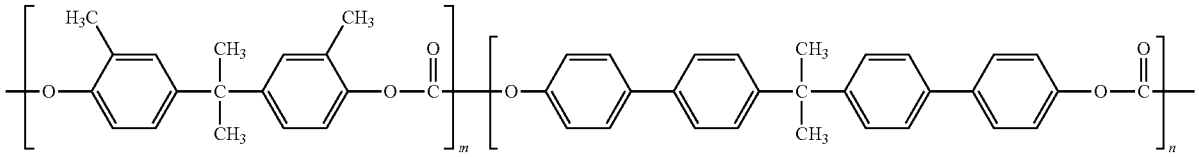

wherein m can be from about 50 mol % to about 99 mol % and n can be from about 1 mol % to about 50 mol %, with a viscosity average molecular weight range of from about 20,000 to about 90,000. In a particular embodiment having this structure, m is 80 mol % and n is 20 mol %, and the viscosity average molecular weight is 62,300.

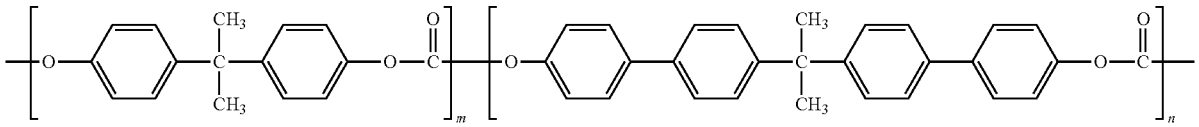

wherein m can be from about 50 mol % to about 99 mol % and n can be from about 1 mol % to about 50 mol %, with a viscosity average molecular weight range of from about 20,000 to about 90,000. In a particular embodiment having this structure, m is 70 mol % and n is 30 mol %, and the viscosity average molecular weight is 54,800. In another particular embodiment having this structure, m is 75 mol % and n is 25 mol %, and the viscosity average molecular weight is 52,500. In yet another particular embodiment having this structure, m is 80 mol % and n is 20 mol %, and the viscosity average molecular weight is 62,600.

In the above structures, both m/n ratio and molecular weight can be varied for optimizing properties. In the present embodiments, the tetra-aryl polycarbonate copolymer is present in the charge transport layer in an amount of from about 20 to about 80, or from about 30 to about 70, or from about 40 to about 60 percent by weight of the total weight of the charge transport layer. In imaging members comprising such charge transport layers, there is exhibited improved wear rate of from about 20 to about 70, or from about 25 to about 65, or from about 30 to about 60 nm/kcycle.

Generally, examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), and epoxies, and random or alternating copolymers thereof. In embodiments electrically inactive binders are comprised of polycarbonate resins with for example a molecular weight of from about 20,000 to about 150,000 and more specifically with a molecular weight $M_w$ of from about 30,000 to about 100,000. Examples of polycarbonates are poly(4,4'-isopropylidene-diphenylene)carbonate (also referred to as bisphenol-A-polycarbonate), poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. In embodiments, the charge transport layer, such as a hole transport layer, may have a thickness from about 10 μm to about 50 μm.

Examples of antioxidants optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infrared radiation drying, air drying and the like. The thickness of the charge transport layer after drying is from about 5 μm to about 50 μm, from about 10 μm to about 50 μm or from about 12 μm to about 36 μm for optimum photoelectrical and mechanical results. In another embodiment the thickness is from about 14 μm to about 36 μm.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts disclosed herein may be used for other purposes where cycling durability is important.

The prepared imaging drum may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The electrophotographic device can be evaluated by printing in a marking engine into which a photoreceptor belt formed according to the exemplary embodiment has been installed. For intrinsic electrical properties it can also be investigated by conventional electrical drum scanners.

Figure 2:
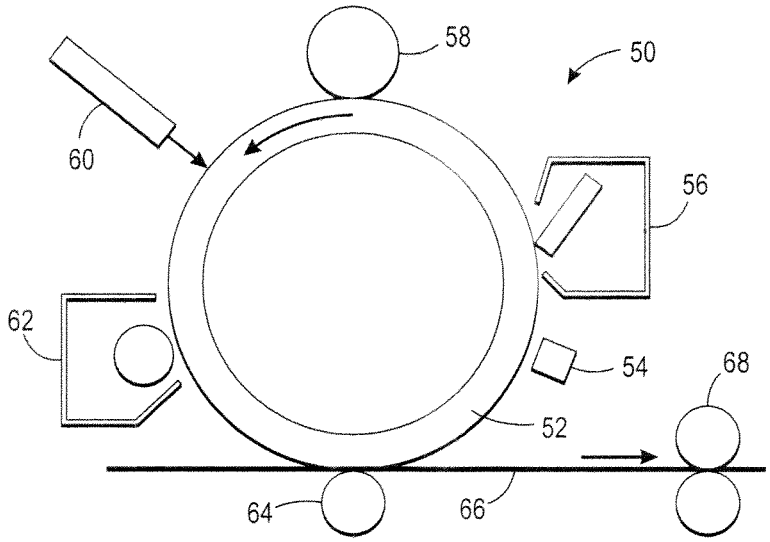
FIG. 2 is a schematic nonstructural view showing an image forming apparatus according to the present embodiments.

FIG. 2 shows a schematic constitution of an embodiment of an image forming apparatus 50. The image forming apparatus 50 is equipped with an imaging member 52, such as a cylindrical imaging or photoreceptor drum, having a charge retentive surface to receive an electrostatic latent image thereon. Around the imaging member 52 may be disposed a static eliminating light source 54 for eliminating residual electrostatic charges on the imaging member 52, an optional cleaning blade 56 for removing the toner remained on the imaging member 52, a charging component 58, such as a charger roll, for charging the imaging member 52, a light-exposure laser optical system 60 for exposing the imaging member 52 based on an image signal, a development component 62 to apply developer material to the charge-retentive surface to create a developed image in the imaging member 52, and a transfer component 64, such as a transfer roll, to transferring a toner image from the imaging member 52 onto a copy substrate 66, such as paper, in this order. Also, the image forming apparatus 50 is equipped with a fusing component 68, such as a fuser/fixing roll, to fuse the toner image transferred onto the copy substrate 66 from the transfer component 64.

The light exposure laser optical system 60 is equipped with a laser diode (for example, oscillation wavelength 780 nm) for irradiating a laser light based on an image signal subjected to a digital treatment, a polygon mirror polarizing the irradiated laser light, and a lens system of moving the laser light at a uniform velocity with a definite size.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

A belt photoconductor was prepared comprising a silane blocking layer (BLS), an ARDEL aromatic polyester adhesive interfacial layer (IFL), a charge generation layer and a charge transport layer. The charge generation layer comprised TiOPc (V)/tetra-aryl polycarbonate copolymer with the tetra-aryl polycarbonate copolymer having the below structure

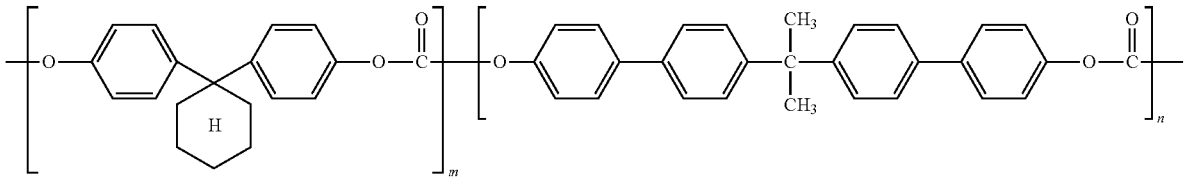

wherein m is 70 mol % and n is 30 mol %, and the viscosity average molecular weight is 56,900. The charge transport layer comprised the same tetra-aryl polycarbonate copolymer and N,N'-bis(3-methylphenyl)-N,N'-diphenyl-(1,1'-biphenyl)-4,4"-diamine (mTBD) at 50/50.

The charge generation layer coating dispersion was prepared as following: in a 120 ml amber bottle, 2.4 grams of TiOPc (V) were mixed with 0.45 gram of the tetra-aryl polycarbonate copolymer in 44.65 grams of monochlorobenzene. 300 grams of 2 mm stainless steel shot were added to the mixture, and the bottle was rotated at 200 rpm for 6 hours on a roll mill. The above mill base was collected, and further let down with the corresponding polymer solution. For every 10 grams of the mill base, a solution of 0.41 gram of tetra-aryl polycarbonate copolymer and 7.96 grams of monochlorobenzene was added and mixed on a shaker for half an hour before coating.

Control

A control belt photoconductor was prepared in the same manner as described above in Example 1 except that the tetra-aryl polycarbonate copolymer is replaced with PCZ-200 polycarbonate.

Testing

Figure 3:
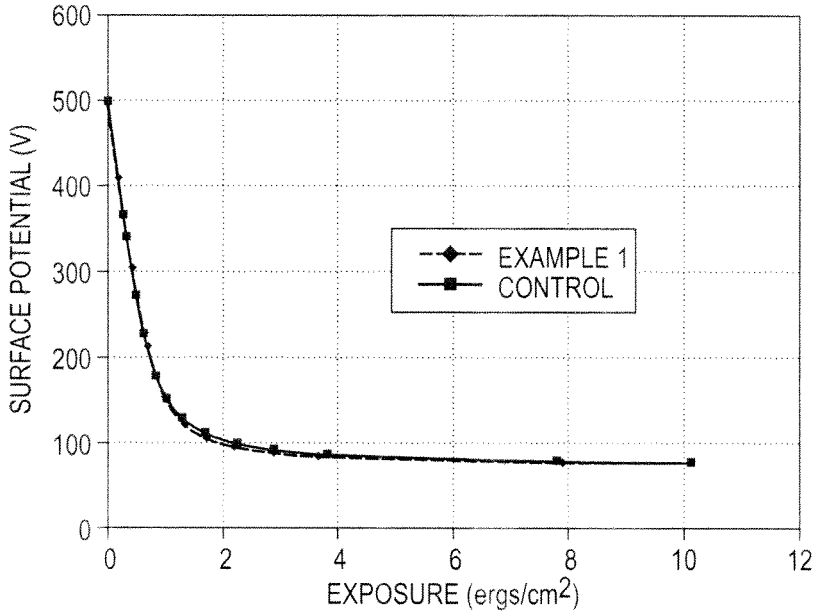
FIG. 3 is a graph illustrating the PIDC (photo-induced discharge curve) at t=0 for a control photoconductor as compared to a photoconductor made according to the present embodiments.
Figure 4:
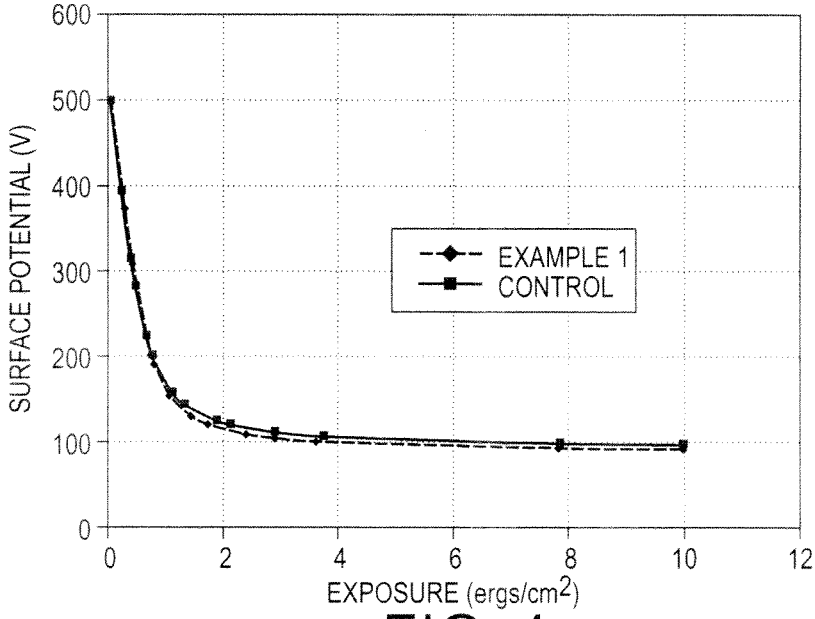
FIG. 4 is a graph illustrating the PIDC at t=10K for a control photoconductor as compared to a photoconductor made according to the present embodiments.

The two above photoconductors were tested for t=0 PIDC (photo-induced discharge curve) (FIG. 3) and t=10 k PIDC (FIG. 4, after 10 k cycling). With a charge transport layer having a thickness of about 29 micron, both photoconductors showed very high sensitivity of about 600 $Vcm^2/erg$, compared with about 400 $Vcm^2/erg$ for a HOGaPc (V) photoconductor. The t=0 PIDCs are very close, and the disclosed inventive photoconductor showed about 10V less $V_r$ cycle up after 10 k cycling than the control photoconductor.

Figure 5:
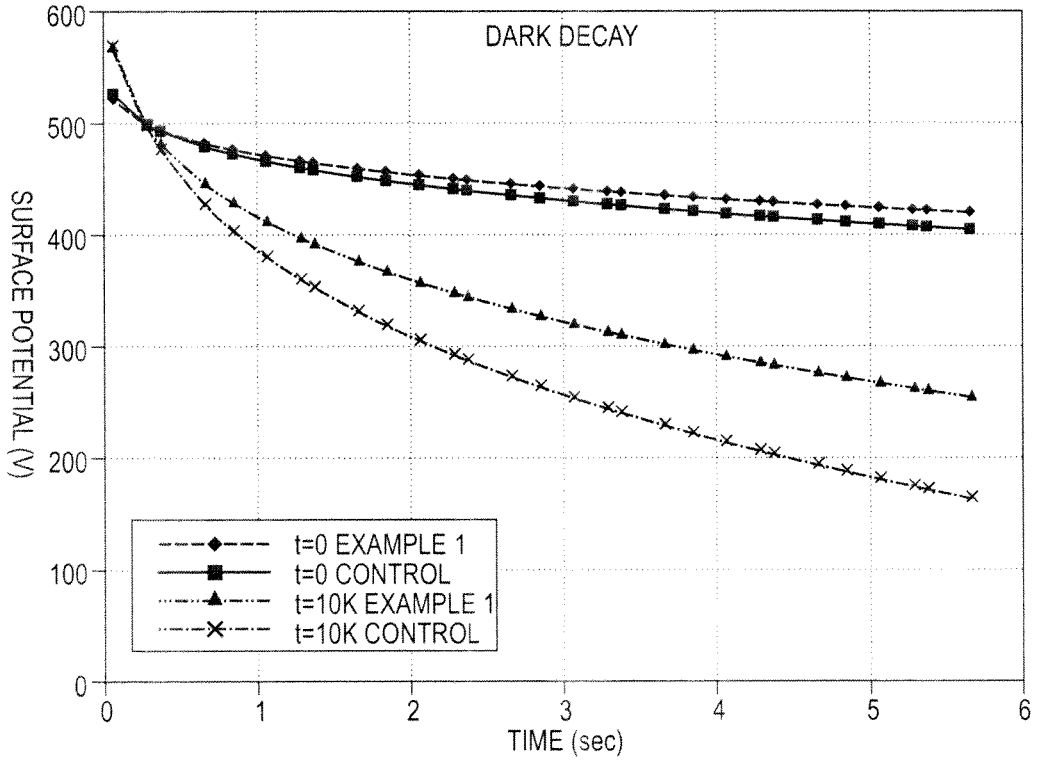
FIG. 5 is a graph illustrating monitored dark decay before and after the 10 k cycling.

FIG. 4 shows the results of monitored dark decay before and after the 10 k cycling (FIG. 5). At t=0, the inventive photoconductor showed about 15V less dark decay than the control photoconductor. After 10 k cycling, the disclosed inventive photoconductor showed about 90V less dark decay than the control CG photoconductor.

In summary, the present embodiments disclose a high-speed/long life belt photoconductor comprising a TiOPc (V)/tetraaryl polycarbonate copolymer CGL and a tetraaryl polycarbonate copolymer/mTBD SMTL which also exhibit improved electrical performance as compared to an imaging member with conventionally prepared charge generation and charge transport layers.

The above exemplary embodiments demonstrated excellent resistance to abrasion, cyclic stability, and discharge characteristics. Such imaging members also have demonstrated the capability of producing high quality black and color prints at elevated process speeds in an imaging system with reduced ghosting observed in prints at elevated positive transfer current, e.g., in a range of from about 20 to about 55 μA.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a conductive substrate;

a charge generation layer disposed on the substrate; and a charge transport layer disposed on the charge generation layer; wherein both the charge generation layer and the charge transport layer comprise a polymeric binder comprising a tetra-aryl polycarbonate copolymer selected from the group consisting of

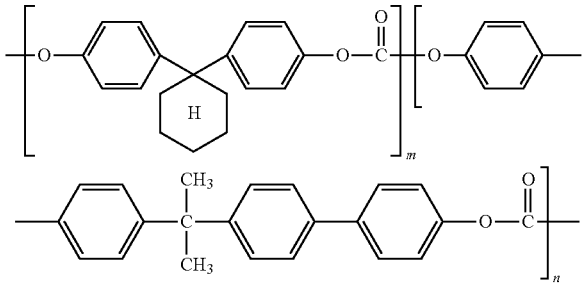

wherein m is from about 50 mol % to about 99 mol % and n is from about 1 mol % to about 50 mol %, with a viscosity average molecular weight range of from about 20,000 to about 90,000;

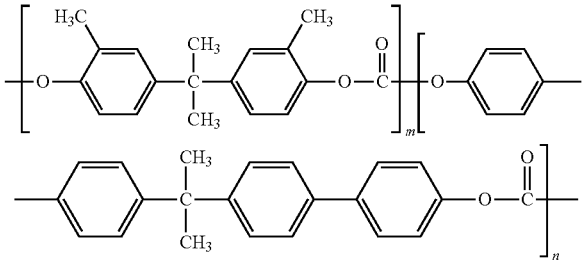

wherein m is from about 50 mol % to about 99 mol % and n is from about 1 mol % to about 50 mol %, with a viscosity average molecular weight range of from about 20,000 to about 90,000;

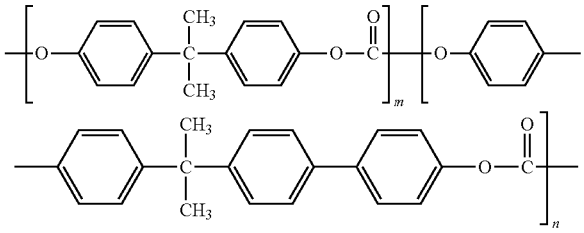

wherein m is from about 50 mol % to about 99 mol % and n is from about 1 mol % to about 50 mol %, with a viscosity average molecular weight range of from about 20,000 to about 90,000;

and mixtures thereof.

2. The imaging member of claim 1, wherein the tetra-aryl polycarbonate copolymer is present in the charge generation layer in an amount of from about 10 to about 90 percent by weight of the total weight of the charge generation layer.

3. The imaging member of claim 1, wherein the tetra-aryl polycarbonate copolymer is present in the charge transport layer in an amount of from about 20 to about 80 percent by weight of the total weight of the charge transport layer.

4. The imaging member of claim 1, wherein the charge generation layer has a thickness of from about 0.1 micrometer to about 2 micrometers.

5. The imaging member of claim 1, wherein the charge transport layer has a thickness of from about 5 micrometers to about 50 micrometers.

6. The imaging member of claim 1, wherein the charge generation layer further comprises a pigment selected from the group consisting of chlorogallium phthalocyanine, hydroxygallium phthalocyanine and titanylphthalocyanine.

7. The imaging member of claim 1, wherein the charge transport layer further comprises an antioxidant.

8. An imaging member comprising:

a conductive substrate;

a charge generation layer disposed on the substrate;

a charge transport layer disposed on the charge generation layer; wherein both the charge generation layer and the charge transport layer comprise a polymeric binder comprising a tetra-aryl polycarbonate copolymer, wherein the tetra-aryl polycarbonate copolymer is selected from the group consisting of:

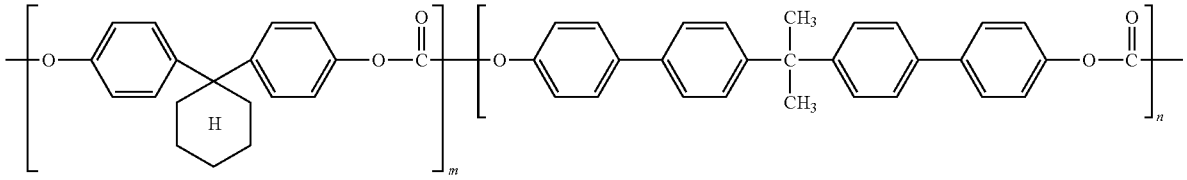

wherein m is from about 60 mol % to about 95 mol % and n is from about 5 mol % to about 40 mol %, with a viscosity average molecular weight range of from about 30,000 to about 70,000;

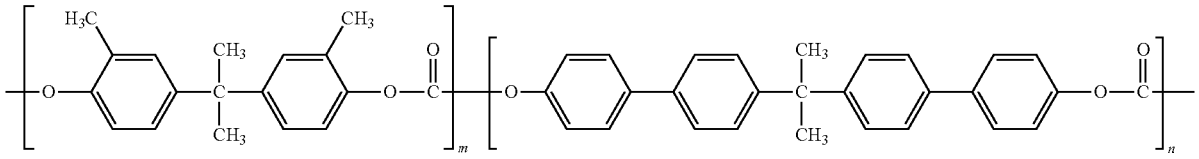

wherein m is from about 60 mol % to about 95 mol % and n is from about 5 mol % to about 40 mol %, with a viscosity average molecular weight range of from about 30,000 to about 70,000;

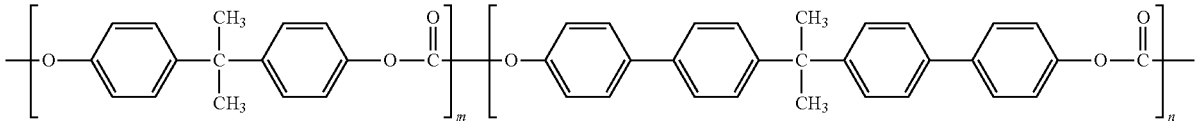

wherein m is from about 60 mol % to about 95 mol % and n is from about 5 mol % to about 40 mol %, with a viscosity average molecular weight range of from about 30,000 to about 70,000 and mixtures thereof.

9. The imaging member of claim 8, wherein the charge generation layer has a thickness of from about 0.1 micrometer to about 2 micrometers and the charge transport layer has a thickness of from about 5 micrometers to about 50 micrometers.

10. An image forming apparatus for forming images on a recording medium comprising:

a) an imaging member having a charge retentive-surface for receiving an electrostatic latent image thereon, wherein the imaging member comprises
a conductive substrate;
a charge generation layer disposed on the substrate;

a charge transport layer disposed on the charge generation layer; and wherein both the charge generation layer and the charge transport layer comprise a polymeric binder comprising a tetra-aryl polycarbonate copolymer selected from the group consisting of

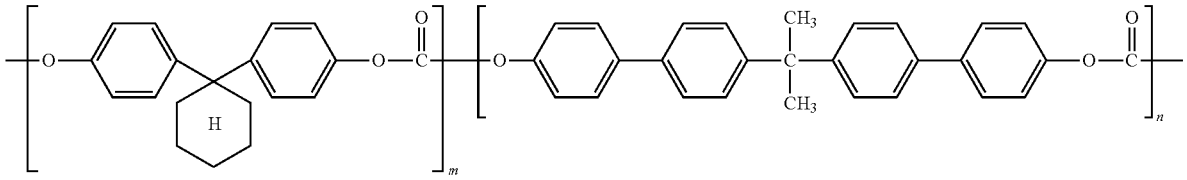

wherein m is from about 50 mol % to about 99 mol % and n is from about 1 mol % to about 50 mol %, with a viscosity average molecular weight range of from about 20,000 to about 90,000;

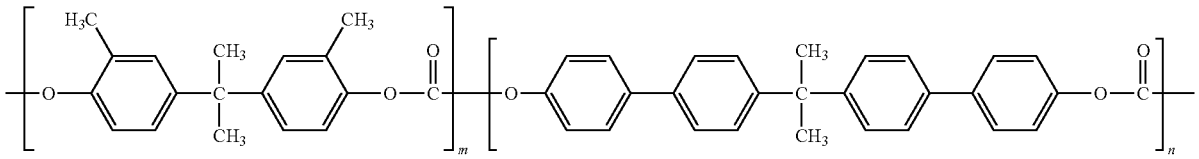

wherein m is from about 50 mol % to about 99 mol % and n is from about 1 mol % to about 50 mol %, with a viscosity average molecular weight range of from about 20,000 to about 90,000;

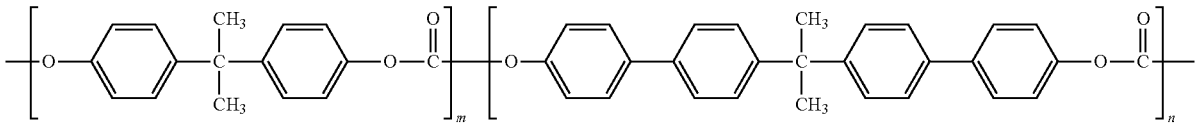

wherein m is from about 50 mol % to about 99 mol % and n is from about 1 mol % to about 50 mol %, with a viscosity average molecular weight range of from about 20,000 to about 90,000;

and mixtures thereof;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

11. The imaging forming apparatus of claim 10, wherein the tetra-aryl polycarbonate copolymer is selected from the group consisting of

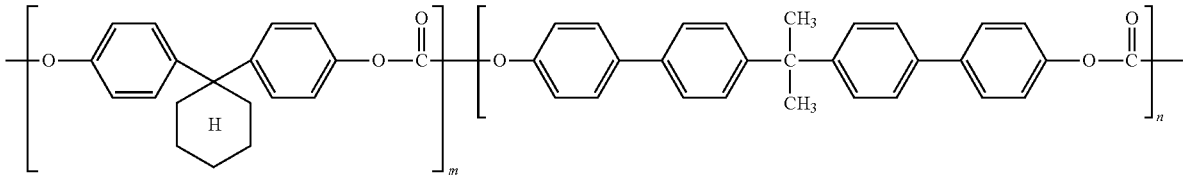

wherein m is from about 60 mol % to about 95 mol % and n is from about 5 mol % to about 40 mol %, with a viscosity average molecular weight range of from about 30,000 to about 70,000;

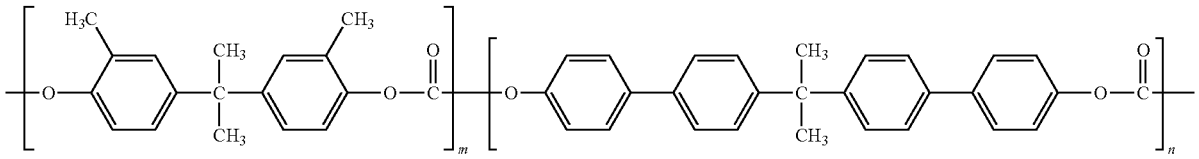

wherein m is from about 60 mol % to about 95 mol % and n is from about 5 mol % to about 40 mol %, with a viscosity average molecular weight range of from about 30,000 to about 70,000;

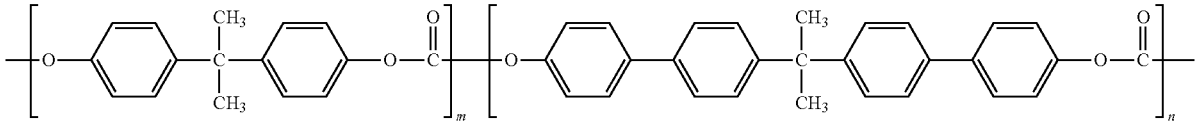

wherein m is from about 60 mol % to about 95 mol % and n is from about 5 mol % to about 40 mol %, with a viscosity average molecular weight range of from about 30,000 to about 70,000;

and mixtures thereof.

12. The imaging forming apparatus of claim 10, wherein the tetra-aryl polycarbonate copolymer is present in the charge generation layer in an amount of from about 20 to about 80 percent by weight of the total weight of the charge generation layer.

13. The imaging forming apparatus of claim 10, wherein the tetra-aryl polycarbonate copolymer is present in the charge transport layer in an amount of from about 30 to about 70 percent by weight of the total weight of the charge transport layer.

* * * * *